US005840672A

United States Patent [19]

Gatto

[11] Patent Number: 5,840,672

[45] Date of Patent: Nov. 24, 1998

[54] ANTIOXIDANT SYSTEM FOR LUBRICATION BASE OILS

[75] Inventor: Vincent James Gatto, Midlothian, Va.

[73] Assignee: Ethyl Corporation, Richmond, Va.

[21] Appl. No.: 896,045

[22] Filed: Jul. 17, 1997

[51] Int. Cl.[6] ..... C10M 141/02; C10M 141/06; C10M 141/08

[52] U.S. Cl. ..... 508/334; 508/364; 508/563; 508/584

[58] Field of Search ..... 508/322, 334, 508/563, 364, 584

[56] References Cited

U.S. PATENT DOCUMENTS

| | | | |
|---|---|---|---|
| 3,285,942 | 11/1966 | Price et al. | 260/429 |
| 4,095,963 | 6/1978 | Lineberry | 55/54 |
| 4,164,473 | 8/1979 | Coupland et al. | 252/32.7 |
| 4,175,043 | 11/1979 | Horodysky | 252/32.7 |
| 4,192,757 | 3/1980 | Brewster | 252/32.7 |
| 4,201,683 | 5/1980 | Brewster | 252/32.7 |
| 4,248,720 | 2/1981 | Coupland et al. | 252/42.7 |
| 4,266,945 | 5/1981 | Karn | 44/68 |
| 4,326,972 | 4/1982 | Chamberlin | 508/331 |
| 4,360,438 | 11/1982 | Rowan et al. | 252/33.6 |
| 4,370,246 | 1/1983 | deVries et al. | 508/328 |
| 4,394,279 | 7/1983 | De Vries et al. | 252/46.4 |
| 4,428,848 | 1/1984 | Levine et al. | 252/32.7 |
| 4,479,883 | 10/1984 | Shaub et al. | 252/33.6 |
| 4,593,012 | 6/1986 | Usui et al. | 502/167 |
| 4,648,985 | 3/1987 | Thorsell et al. | 252/35 |
| 4,692,256 | 9/1987 | Umemura et al. | 252/32.7 |
| 4,812,246 | 3/1989 | Yabe | 252/32.7 |
| 4,832,857 | 5/1989 | Hunt et al. | 252/33 |
| 4,846,983 | 7/1989 | Ward | 252/33.6 |
| 4,889,647 | 12/1989 | Rowan et al. | 252/42.7 |
| 5,137,647 | 8/1992 | Karol | 252/33.6 |
| 5,232,614 | 8/1993 | Colclough et al. | 252/50 |
| 5,412,130 | 5/1995 | Karol | 556/57 |
| 5,605,880 | 2/1997 | Arai et al. | 508/379 |
| 5,641,731 | 6/1997 | Baumgart et al. | 508/183 |
| 5,650,381 | 7/1997 | Gatto et al. | 508/364 |
| 5,688,748 | 11/1997 | Tomizawa | 508/363 |
| 5,712,230 | 1/1998 | Abraham | 508/232 |
| 5,736,491 | 4/1998 | Patel et al. | 508/365 |

FOREIGN PATENT DOCUMENTS

| | | |
|---|---|---|
| 0447916 A1 | 9/1991 | European Pat. Off. . |
| 737735 | 10/1996 | European Pat. Off. . |
| 95/07962 | 3/1995 | WIPO . |
| 95/07963 | 3/1995 | WIPO . |
| 95/07966 | 3/1995 | WIPO . |
| 95/27022 | 10/1995 | WIPO . |
| 96/37583 | 11/1996 | WIPO . |

*Primary Examiner*—Jacqueline V. Howard
*Attorney, Agent, or Firm*—Dennis H. Rainear; Thomas Hamilton

[57] ABSTRACT

This invention relates to antioxidant compositions comprising (A) at least one secondary diarylamine, (B) at least one sulfurized olefin and/or sulfurized hindered phenol, and (C) at least one oil soluble molybdenum compound. These antioxidant compositions are highly effective at providing oxidative stability to lubricating compositions, especially for highly saturated, low sulfur lubrication base oils.

24 Claims, No Drawings

ANTIOXIDANT SYSTEM FOR LUBRICATION BASE OILS

TECHNICAL FIELD

This invention relates to an antioxidant system which exhibits excellent nitrile elastomer seal compatibility and its use in fully formulated lubricants. More specifically, this invention relates to antioxidant compositions comprising (A) at least one secondary diarylamine, (B) at least one sulfurized olefin and/or sulfurized hindered phenol, and (C) at least one oil soluble molybdenum compound.

BACKGROUND

Lubricating oils as used in the internal combustion engines of automobiles and trucks are subjected to a demanding environment during use. The environment results in the oil suffering oxidation which is catalyzed by the presence of impurities in the oil and is promoted by the elevated temperatures of the oil during use. The oxidation of lubrication oils during use is usually controlled to some extent by the use of antioxidant additives which may extend the useful life of the oil, particularly by reducing or preventing unacceptable viscosity increases.

It has now been discovered that a combination of (A) secondary diarylamine(s), (B) sulfurized olefin(s) and/or sulfurized hindered phenol(s), and (C) oil soluble molybdenum compounds gives a highly effective antioxidant system.

U.S. Pat. No. 5,605,880 discloses alkylated diphenylamines and phenyl-alpha-naphthyl amines in combination with oxymolybdenum sulfide dithiocarbamates and oxymolybdenum sulfide organophosphorodithioates in lubricant compositions. However, these references do not teach the use of sulfurized olefins or sulfurized hindered phenols.

WO 95/07963 discloses mixtures of sulfur containing molybdenum compounds and alkylated diphenylamines. The reference mentions that other antioxidants, such as sulfurized olefins or sulfurized hindered phenols, may be present, however, the reference does not specifically teach the use of a three component antioxidant system or recognize that the three component systems exhibit significantly more effective antioxidant systems than the two component compositions of the reference.

SUMMARY OF THE INVENTION

An objective of this invention is to impart a very high level of oxidation protection and viscosity control, without hardening nitrile elastomer seals, to fully formulated lubricant compositions containing low levels of ZDDP derived phosphorus, typically less than 850 ppm of phosphorus, using hydrocracked and/or hydroisomerized mineral base oils, by incorporating into said lubricant compositions an antioxidant composition comprising (A) secondary diarylamines, (B) sulfurized olefins and/or sulfurized hindered phenols, and (C) at least one oil soluble molybdenum compound. This three component antioxidant system provides antioxidant protection for the above mentioned base oils that is superior to the protection obtained with combinations of any two of these components.

In one aspect, the invention is directed to lubricating oil compositions comprising a base oil and an antioxidant composition comprising (A) secondary diarylamines, (B) sulfurized olefins and/or sulfurized hindered phenols, and (C) at least one oil soluble molybdenum compound.

In another aspect, the invention is directed to a method for improving the antioxidancy and nitrile elastomer seal compatibility of a lubricant by incorporating in the lubricant an antioxidant composition comprising (A) secondary diarylamines, (B) sulfurized olefins and/or sulfurized hindered phenols, and (C) at least one oil soluble molybdenum compound.

In yet another aspect, the invention is directed to a lubrication oil concentrate comprising a solvent and a combination of (A) secondary diarylamines, (B) sulfurized olefins and/or sulfurized hindered phenols, and (C) at least one oil soluble molybdenum compound.

DETAILED DESCRIPTION OF THE INVENTION

Component (A)—Secondary Diarylamines

The secondary diarylamines used in this invention should be soluble in the formulated oil package or package concentrate. Preferably the secondary diarylamine has the general formula: $R_1$—NH—$R_2$, wherein $R_1$ and $R_2$ each independently represents a substituted or unsubstituted aryl group having from 6 to 30 carbon atoms. Illustrative substituents for the aryl include alkyl groups having from 1 to 20 carbon atoms, alkylaryl groups, hydroxy, carboxy and nitro groups. The aryl is preferably substituted or unsubstituted phenyl or naphthyl, particularly wherein one or both of the aryl groups are substituted with an alkyl. It is preferred that both aryl groups be alkyl substituted.

Examples of secondary diarylamines which can be used in the present invention include diphenylamine, alkylated diphenylamines, 3-hydroxydiphenylamine, N-phenyl-1,2-phenylenediamine, N-phenyl-1,4-phenylenediamine, butyldiphenylamine, dibutyldiphenylamine, octyldiphenylamine, dioctyldiphenylamine, nonyldiphenylamine, dinonyldiphenylamine, phenyl-alpha-naphthylamine, phenyl-beta-naphthylamine, heptyldiphenylamine, diheptyldiphenylamine, methylstyryldiphenylamine, mixed butyl/octyl alkylated diphenylamines, mixed butyl/styryl alkylated diphenylamines, mixed ethyl/nonyl alkylated diphenylamines, mixed octyl/styryl alkylated diphenylamines, mixed ethyl/methylstyryl alkylated diphenylamines, octyl alkylated phenyl-alpha-naphthylamine and combinations of these of varying degrees of purity that are commonly used in the petroleum industry.

Examples of commercial secondary diarylamines include Irganox® L06 and Irganox® L57 from Ciba-Geigy Corporation; Naugalube® AMS, Naugalube® 438, Naugalube® 438R, Naugalube® 438L, Naugalube® 500, Naugalube® 640, Naugalube® 680, and Naugard® PANA from Uniroyal Chemical Company; Goodrite® 3123, Goodrite® 3190X36, Goodrite® 3127, Goodrite® 3128, Goodrite® 3185X1, Goodrite® 3190X29, Goodrite® 3190X40, and Goodrite® 3191 from BF Goodrich Specialty Chemicals; Vanlube® DND, Vanlube® NA, Vanlube® PNA, Vanlube® SL, Vanlube® SLHP, Vanlube® SS, Vanlube® 81, Vanlube® 848, and Vanlube® 849 from R. T. Vanderbilt Company, Inc.

It is preferred that the nitrogen content of the secondary diarylamines be between about 2 wt % and about 12 wt % of the neat additive concentrate. The concentration of the secondary diarylamine in the formulated lubricant oil can vary depending upon the customers requirements and applications, and the desired level of antioxidant protection required for the specific formulated oil. Typically the secondary diarylamines are present in the formulated oil in an amount of about 0.05 wt % to about 0.5 wt %, preferably from about 0.1 wt % to about 0.4 wt %.

Component (B)—Sulfurized Olefins and/or Sulfurized Hindered Phenols

The sulfurized olefins useful in the present invention can be prepared by a number of known methods. They are characterized by the type of olefin used in their production and their final sulfur content. High molecular weight olefins, i.e., those olefins having an average molecular weight of 168 to 351 g/mole, are preferred. Examples of olefins that may be used include alpha-olefins, isomerized alpha-olefins, branched olefins, cyclic olefins, and combinations of these.

Suitable alpha-olefins include any $C_4$–$C_{25}$ alpha-olefins. Alpha-olefins may be isomerized before the sulfurization reaction or during the sulfurization reaction. Structural and/or conformational isomers of the alpha olefin that contain internal double bonds and/or branching may also be used. For example, isobutylene is the branched olefin counterpart of the alpha-olefin 1-butene.

Sulfur sources that may be used in the sulfurization reaction include: elemental sulfur, sulfur monochloride, sulfur dichloride, sodium sulfide, sodium polysulfide, and mixtures of these added together or at different stages of the sulfurization process.

Unsaturated fatty acids and oils, because of their unsaturation, may also be sulfurized and used in this invention. Examples of fatty acids that may be used include lauroleic acid, myristoleic acid, palmitoleic acid, oleic acid, elaidic acid, vaccenic acid, linoleic acid, linolenic acid, gadoleic acid, arachidonic acid, erucic acid, and mixtures of these. Examples of oils or fats that may be used include corn oil, cottonseed oil, grapeseed oil, olive oil, palm oil, peanut oil, rapeseed oil, safflower seed oil, sesame seed oil, soyabean oil, sunflower seed oil, and combinations of these.

The concentration of sulfurized olefin in the formulated lubricant oil can vary depending upon the customers requirement and applications, and the desired level of antioxidant protection required for the specific formulated oil. An important criteria for selecting the concentration of the sulfurized olefin used in the formulated oil is the sulfur concentration of the sulfurized olefin itself. The sulfurized olefin should deliver between 0.05 wt % and 0.30 wt % of sulfur to the finished lubricant formulation. For example, a sulfurized olefin containing 20 wt % sulfur content should be used at levels between 0.25 wt % and 1.5 wt % to deliver between 0.05 wt % and 0.30 wt % sulfur to the finished oil. A sulfurized olefin containing 10 wt % sulfur content should be used between 0.5 wt % and 3.0 wt % to deliver between 0.05 wt % and 0.30 wt % sulfur to the finished oil.

Examples of commercial sulfurized olefins which may be used in the present invention include HiTEC® 7084 which contains approximately 20 wt % sulfur content, HiTEC® 7188 which contains approximately 12 wt % sulfur content, HiTEC® 312 which contains approximately 47.5 wt % sulfur content, and HiTEC® 313 which contains approximately 47.5 wt % sulfur content, all from Ethyl Corporation, and Additin® RC 2540-A which contains approximately 38 wt % sulfur content, from Rhein Chemie Corporation. Commercially available sulfurized fatty oils, or mixtures of sulfurized fatty oils and olefins, that may be used in the present invention include Additin® R 4410 which contains approximately 9.5 wt % sulfur content, Additin® R 4412-F which contains approximately 12.5 wt % sulfur content, Additin® R 4417 which contains approximately 17.5 wt % sulfur content, Additin® RC 2515 which contains approximately 15 wt % sulfur content, Additin® RC 2526 which contains approximately 26 wt % sulfur content, Additin® RC 2810-A which contains approximately 10 wt % sulfur content, Additin® RC 2814-A which contains approximately 14 wt % sulfur content, and Additin® RC 2818-A which contains approximately 16 wt % sulfur content, all from Rhein Chemie Corporation. It is preferred that the sulfurized olefin and/or fatty oil be a liquid of low corrosivity and low active sulfur content as determined by ASTM-D 1662.

The sulfurized hindered phenols suitable for use in the present invention can be prepared by a number of known methods. They are characterized by the type of hindered phenols used in their production and their final sulfur content. Hindered tert-butylphenols are preferred. The sulfurized hindered phenols may be chlorine-free, being prepared from chlorine-free sulfur sources such as elemental sulfur, sodium sulfide, or sodium polysulfide, or they may contain chlorine, being prepared from chlorinated sulfur sources such as sulfur monochloride and sulfur dichloride. Preferred sulfurized hindered phenols include those of the following general structure.

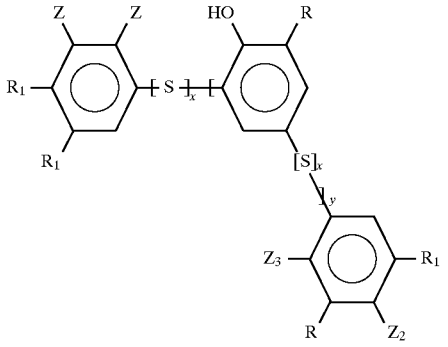

Wherein R is an alkyl group, $R_1$ is selected from the group consisting of alkyl groups and hydrogen, one of Z or $Z_1$ is OH with the other being hydrogen, one of $Z_2$ or $Z_3$ is OH with the other being hydrogen, x is in the range of from 1 to 6, and y is in the range of from 0 to 2.

Suitable chlorine-free, sulfurized hindered phenols may be prepared by the methods taught in U.S. Pat. No. 3,929,654 or may be obtained by (a) preparing a mixture of (i) at least one chlorine-free hindered phenol, (ii) a chlorine-free sulfur source, and (iii) at least one alkali metal hydroxide promoter, in a polar solvent, and (b) causing components (i), (ii) and (iii) to react for sufficient time and at a sufficient temperature so as to form at least one chlorine-free sulfurized hindered phenol, as taught in co-pending application Ser. Nos. 08/657,141 filed Jun. 3, 1996 and 08/877,533 filed Feb. 19, 1997.

Suitable sulfurized hindered phenol products prepared from a chlorinated sulfur source include those products taught in U.S. Pat. Nos. 3,250,712 and 4,946,610, both of which are hereby incorporated by reference.

Examples of sulfurized hindered phenols that may be used in this invention include 4,4'-thiobis(2,6-di-t-butylphenol), 4,4'-dithiobis(2,6-di-t-butylphenol), 4,4'-thiobis(2-t-butyl-6-methylphenol), 4,4'-dithiobis(2-t-butyl-6-methylphenol), 4,4'-thiobis(2-t-butyl-5-methylphenol), and mixtures of these.

It is preferred that the sulfurized hindered phenols be a substantially liquid product. As used herein, substantially liquid refers to compositions that are chiefly liquid. In this regard, aged samples of the sulfurized hindered phenols may form a slight amount of crystallization, generally around the sides of the container where product comes in contact with air and the glass container surface. It is further preferred that the sulfurized hindered phenols be chlorine-free, of low corrosivity and having a high content of monosulfide as described in co-pending application Ser. Nos. 08/657,141 filed Jun. 3, 1996 and 08/877,533 filed Feb. 19, 1997. It is also preferred that the sulfur content of the sulfurized hindered phenol be in the range of 4.0 wt % to 12.0 wt % of the additive concentrate.

The concentration of the sulfurized hindered phenol in the formulated lubrication oil can vary depending upon the customers requirements and applications, as well as the desired level of antioxidant protection required for the specific formulated oil. A preferred use range is between 0.3 wt % and 1.5 wt % in the finished formulated oil.

Mixtures of sulfurized olefins and sulfurized hindered phenols may also be used.

Component (C)—Oil Soluble Molybdenum Compounds

Any oil soluble molybdenum compounds may be used in this invention. A critical requirement is the quantity of molybdenum delivered to the finished formulated oil. The quantity will vary depending upon the customers requirements and applications, and the desired level of antioxidant protection required for the specific formulated oil. Preferred concentrations of molybdenum are between 60 ppm and 1000 ppm in the finished formulated oil. For example, an oil soluble molybdenum compound containing 8.0 wt % molybdenum content should be used between 0.08 wt % and 1.25 wt % to deliver between 64 ppm and 1000 ppm molybdenum to the finished oil.

Examples of some oil soluble molybdenum compounds that may be used in this invention include molybdenum dithiocarbamates, oxymolybdenum sulfide dithiocarbamates, molybdenum dithioxanthogenates, oxymolybdenum sulfide dithioxanthogenates, molybdenum organophosphorodithioates, oxymolybdenum sulfide organophosphorodithioates, molybdenum carboxylates, molybdenum amine complexes, molybdenum alcohol complexes, molybdenum amide complexes, mixed molybdenum amine/alcohol/amide complexes, and combinations of these. Examples of commercially available oil soluble molybdenum compounds that may be used in the present invention include molybdenum octoate, which contains approximately 8.5 wt % molybdenum content, available from the Shepherd Chemical Company; molybdenum HEX-CEM, which contains approximately 15.0 wt % molybdenum content, available from the OM Group; Molyvan® 855, which contains approximately 8.0 wt % molybdenum content, Molyvan® 807, which contains approximately 4.9 wt % molybdenum content, and Molyvan® 822, which contains approximately 4.9 wt % molybdenum content, all available from R. T. Vanderbilt Company, Inc.; SAKURA-LUBE® 100, which contains approximately 4.1 wt % molybdenum content, SAKURA-LUBE® 155, which contains approximately 4.5 wt % molybdenum content, SAKURA-LUBE® 600, which contains approximately 27.5 wt % molybdenum content, and SAKURA-LUBE® 700, which contains approximately 4.5 wt % molybdenum content, all available from Asahi Denka Kogyo K. K.

Phosphorus-free molybdenum compounds are preferred for use in crankcase oil formulations due to the trend to reduce the phosphorus content of motor oils to attain improved automobile catalyst compatibility. Further, it is important to note that the use of sulfurized olefins and sulfurized hindered phenols in finished oils can be limited due to the presence of active sulfur in these additives. Active sulfur can be defined in a number of ways. One test method that determines the amount of active sulfur in an additive is ASTM-D 1662. The presence of active sulfur can also be determined by lubricant bench tests sensitive to the presence of active sulfur. For example, ASTM-D 130 shows high levels of copper corrosion for lubricants containing substantial amounts of active sulfur. Also, the Allison C-4 Nitrile Seal Test shows high levels of nitrile seal hardening for lubricants containing substantial amounts of active sulfur. Lubricants with high levels of active sulfur are undesirable because of these seal compatibility and corrosion concerns. However, these same additives are also very effective high temperature antioxidants. There is a need for a formulation method that would allow the use of antioxidants containing active sulfur but not cause excessive copper corrosion or nitrile seal incompatibility. The use of oil soluble sulfur-free molybdenum compounds, in combination with secondary diarylamines and the sulfurized olefins and/or sulfurized hindered phenols described above, provides both superior antioxidant properties and excellent nitrile seal compatibility required for proper formulation of lubricant oils.

Typically, the antioxidant composition is added to the oil in the form of a package concentrate. The amount of product in the concentrates generally varies from about 5 wt % to 75 wt %, preferably from about 5 wt % to about 50 wt %. The concentrates may also contain other additives such as dispersants, detergents, anti-wear agents, supplemental antioxidants, viscosity index improvers, pour point depressants, corrosion inhibitors, rust inhibitors, foam inhibitors, and friction modifiers.

The dispersants typically are nonmetallic additives containing nitrogen or oxygen polar groups attached to a high molecular weight hydrocarbon chain. The hydrocarbon chain provides solubility in the hydrocarbon base stocks. The dispersants function to keep oil degradation products suspended in the oil. Examples of suitable dispersants include polymethacrylates and styrene maleic ester copolymers, substituted succinimides, polyamine succinimides, polyhydroxy succinic esters, substituted Mannich bases, and substituted triazoles. Generally, the dispersant, if used, will be present in the finished oil in an amount of about 3 wt % to about 10 wt %.

The detergents typically are metallic additives containing metal ions and polar groups, such as sulfonates or carboxylates, with aliphatic, cycloaliphatic, or alkylaromatic chains. The detergents function by lifting deposits from the various surfaces of the engine. Suitable detergents include neutral and overbased alkali and alkaline earth metal sulfonates, neutral and overbased alkali and alkaline earth metal phenates, sulfurized phenates, and overbased alkaline earth salicylates. Generally, the detergent, if used, will be present in the finished oil in an amount of about 1 wt % to about 5 wt %.

Anti-wear additives are generally incorporated into lubricant formulations. A commonly used anti-wear agent, especially for use in formulated crankcase oils, is zinc dihydrocarbyl dithiophosphate (ZDDP). These additives function by reacting with the metal surface to form a new surface active compound which itself is deformed and thus protects the original engine surface. The ZDDP's are responsible for delivering phosphorus to the finished formulated lubricating oils. In crankcase applications, today's passenger car SJ oils have a maximum limit of 1000 ppm phosphorus that is allowed in the finished oil. The presence of phosphorus in finished formulated crankcase oils is believed to increase automotive emissions and thus contribute to pollution. It is therefore desirable to reduce the level of phosphorus, and therefore the level of ZDDP, in finished oils. However, the ZDDP's are very powerful antioxidants. Removal of ZDDP from the finished oils places severe demands on the other antioxidants present in the oil. The three component antioxidant system of this invention is highly effective at reduced phosphorus level, e.g., between 500 ppm and 850 ppm, without sacrifice of antioxidant performance.

Supplemental antioxidants, i.e., antioxidants in addition to the three component antioxidant system of the present invention, may be used in oils that are less oxidatively stable or in oils that are subjected to unusually severe conditions. The antioxidant protection provided by the present three component system is not likely to require additional antioxidants. However, cost factors and engine oil compatibility issues may require the use of other antioxidants. Suitable supplemental antioxidants include hindered phenols, hindered bisphenols, sulfurized alkylphenols, dialkyl dithiocarbamates, phenothiazines, and oil soluble copper compounds.

The optional viscosity index improver (VII) component of this invention may be selected from any of the known VIIs. The function of the VII is to reduce the rate of change of viscosity with temperature, i.e., they cause minimal increase in engine oil viscosity at low temperatures but considerable increase at high temperatures. Examples of suitable VIIs include polyisobutylenes, polymethacrylates, ethylene/propylene copolymers, functionalized ethylene/propylene copolymers, polyacrylates, styrene maleic ester copolymers, and hydrogenated styrene/butadiene copolymers.

The base oils used in forming the lubricating compositions of the present invention are characterized by the presence of a high level of saturates and a very low level of sulfur, compared to Group I base oils, and include base oils referred to in the petroleum additive industry as Group II and Group III base oils. A variety of methods may be used to manufacture these oils. The oils produced are generally referred to as severely hydrotreated oils or hydrocracked oils. They are prepared from conventional feedstocks using a severe hydrogenation step to reduce the aromatic, sulfur and nitrogen content, followed by dewaxing, hydrofinishing, extraction and/or distillation steps to produce the finished base oil. The oils of the present invention generally contain greater than or equal to 90% saturates, less than or equal to 0.03 weight percent sulfur and have a viscosity index of greater than or equal to 80.

There are a number of recent trends in the petroleum additive industry that may restrict and/or limit the use of certain additives in formulated crankcase oils. The key trends are the move to lower phosphorus levels in oils, new fuel economy requirements, the use of more highly refined base oils, and the move to more severe engine and bench test conditions for qualifying oils. Such changes may show that certain currently used antioxidant additives do not provide the desired protection against oil oxidation. The three component antioxidant system of the present invention provides a solution to this need. This invention also provides a formulation method that allows the use of sulfurized antioxidants that previously could not be used because of corrosion issues and nitrile seal compatibility issues.

EXAMPLES

Example 1

A series of passenger car motor oils were blended as defined in Table 1. The oils were formulated using polymeric dispersants, sulfonate detergents, ZDDP, an anti-foam agent, a viscosity index improver, a pour point depressant and a diluent process oil to prepare SAE grade 5W-30 motor oils. The additive antioxidants and base oils used are defined in Table 1. These oils were evaluated in the Sequence IIIE engine test following ASTM STP 315H Part 1. The IIIE test uses a 231 CID (3.8) liter Buick V-6 engine at high speed (3,000 rpm) and a very high oil temperature of 149° C. for 64 hours. This test is used to evaluate an engine oil's ability to minimize oxidation, thickening, sludge, varnish, deposits, and high temperature wear.

Additive package concentrate #1 was blended to deliver approximately 900 ppm of ZDDP derived phosphorus to the finished oil and was formulated with an amount of polymeric dispersant sufficient for effective sludge control in the conventional hydrofinished oils. Additive package concentrate #2 was blended to deliver approximately 900 ppm of ZDDP derived phosphorus to the finished oil and was formulated with an amount of polymeric dispersant sufficient for sludge control in the ultra low sulfur hydrocracked oils. Additive package concentrate #3 was blended to deliver approximately 820 ppm of ZDDP derived phosphorus to the finished oil and was formulated with an amount of polymeric dispersant sufficient for sludge control in the ultra low sulfur hydrocracked oils.

The 100N and 240N hydrocracked base oils were obtained from Chevron Chemical Company and typically contain less than 50 ppm sulfur, less than 5 ppm nitrogen, between 95 and 99% saturates, and between 1 and 4% aromatics. The 100N and 325N hydrofinished base oils were obtained from Ashland Oil Company and contained 0.31 wt % and 0.88 wt % sulfur, respectively, and are further characterized, relative to the hydrocracked oils, by a higher nitrogen content, a lower level of saturates, and a higher level of aromatics.

The sulfurized olefin used was a $C_{16-18}$ sulfurized olefin containing approximately 20 wt % sulfur, commercially available as HiTEC® 7084 sulfurized olefin from Ethyl Corporation. The molybdenum 2-ethylhexanoate used was molybdenum HEX-CEM, an oil soluble molybdenum compound containing approximately 15 wt % molybdenum obtained from The OM Group. The organo molybdenum complex is Molyvan® 855, a sulfur and phosphorus free molybdenum compound available from R. T. Vanderbilt Company, Inc. The alkylated diphenylamine is Naugalube® 680, an octyl/styryl alkylated diphenylamine available from Uniroyal Chemical Company, Inc.

TABLE 1

| | Antioxidant evaluations in the Sequence IIIE | | | | | | |
|---|---|---|---|---|---|---|---|
| | Oil #1* | Oil #2* | Oil #3* | Oil #4* | Oil #5* | Oil #6 | Oil #7 |
| Package Type | | | | | | | |
| Additive Package Conc. #1 | 17.715 | 17.715 | | | | | |
| Additive Package Conc. #2 | | | 16.150 | 16.015 | | | |
| Additive Package Conc. #3 | | | | | 15.500 | 15.500 | 15.500 |

TABLE 1-continued

| | | Antioxidant evaluations in the Sequence IIIE | | | | | | |
|---|---|---|---|---|---|---|---|---|
| | | Oil #1* | Oil #2* | Oil #3* | Oil #4* | Oil #5* | Oil #6 | Oil #7 |
| Antioxidant Type | | | | | | | | |
| Sulfurized Olefin | | | | | | 0.700 | 0.700 | 0.700 |
| Molybdenum 2-ethylhexanoate | | 0.085 | 0.085 | 0.150 | 0.085 | | 0.112 | |
| Organo Molybdenum Complex | | | | | | | | 0.210 |
| alkylated diphenylamine | | 0.200 | 0.200 | 0.200 | 0.400 | 0.300 | 0.300 | 0.300 |
| Base Oil Type | | | | | | | | |
| 100N low S hydrocracked | | | 77.000 | 72.900 | 72.900 | 72.900 | 72.900 | 72.900 |
| 240N low S hydrocracked | | | 5.000 | 10.600 | 10.600 | 10.600 | 10.600 | 10.600 |
| 100N hydrofinished | | 76.000 | | | | | | |
| 325N hydrofinished | | 6.000 | | | | | | |
| Analytical | | | | | | | | |
| Calculated P (ppm) | | 900 | 900 | 900 | 900 | 820 | 820 | 820 |
| Calculated Mo (ppm) | | 128 | 128 | 225 | 128 | 0 | 168 | 168 |
| Viscosity increase(% change) | | | | | | | | |
| 8 hours | | 16 | 11 | −5 | −5 | −3 | −3 | −4 |
| 16 hours | | 23 | 18 | −6 | −5 | −2 | −3 | −4 |
| 24 hours | | 25 | 22 | −8 | −4 | 1 | 0 | −1 |
| 32 hours | | 26 | 16 | 16 | −4 | 1 | 2 | 0 |
| 40 hours | | 45 | 54 | 73 | 17 | −3 | 5 | −2 |
| 48 hours | | 85 | 140 | 194 | 84 | 146 | 6 | −6 |
| 56 hours | | 159 | 422 | 672 | 216 | 522 | 6 | 9 |
| 64 hours (375 Max) | | 300 | 2,541 | 2,486 | 854 | 3,576 | −1 | 40 |
| IIE Results | Limits | | | | | | | |
| Hrs to 375% Vis Inc. | Min 64 | 66.4 | 54.7 | 51 | 58 | 52.9 | 85.8 | 81 |
| AE Sludge | Min 9.2 | 9.56 | 9.34 | 9.25 | 9.36 | 9.25 | 9.75 | 9.62 |
| APS Varnish | Min 8.9 | 9.38 | 9.1 | 8.78 | 8.9 | 8.6 | 9.33 | 9 |
| ORL Deposit | Min 3.5 | 4.8 | 3.59 | 2.54 | 3.54 | 2.88 | 4.46 | 3.76 |
| AC Wear | Max 30 | 6.5 | 7.6 | 10.4 | 10.6 | 10.5 | 11.8 | 8.8 |
| MC Wear | Max 64 | 11 | 11 | 14 | 20 | 13 | 15 | 13 |
| Oil Consumption, L | Max 5.1 | 3.55 | 3.61 | 3.73 | 3.21 | 3.89 | 2.56 | 2.78 |

*Comparative Examples

The Sequence IIIE results in Table I show a variety of effects. (1) A two component antioxidant system composed of molybdenum and alkylated diphenylamines is effective at controlling viscosity and passing the IIIE in the high sulfur hydrofinished oils (Oil #1), but is much less effective in the ultra low sulfur hydrocracked oils (Oils #2–4) even when adjusting the antioxidant treat levels in the low sulfur hydrocracked oils. (2) A two component antioxidant composed of sulfurized olefin and alkylated diphenylamines (Oil #5) is ineffective at controlling viscosity and passing the IIIE in the low sulfur hydrocracked oils containing low (820 ppm) levels of phosphorus. (3) When a three component antioxidant system of the present invention (Oils #6 and 7) composed of sulfurized olefin, alkylated diphenylamine, and molybdenum is used in the ultra low sulfur hydrocracked oils a significant improvement in the oils ability to control viscosity and pass the IIIE is seen.

The results of Table 1 clearly demonstrate that for effective viscosity control in ultra low sulfur hydrocracked oils formulated with low levels of phosphorus, a three way antioxidant system composed of sulfurized olefin, alkylated diphenylamines, and oil soluble molybdenum gives far superior results compared to conventional two component (i.e., molybdenum with diphenylamines or sulfurized olefins with diphenylamines) antioxidant systems.

Example 2

An SAE grade 5W-30 passenger car motor oil was blended as set forth in Table 2. Oils #8 and 9 were formulated using an additive package concentrate composed of polymeric dispersants, sulfonate detergents, zinc dialkyl dithiophosphate (ZDDP), an antifoam agent, a viscosity index improver, a pour point depressant, a diluent process oil, and the antioxidants listed in Table 2. The two oils were evaluated in the Sequence IIIE engine test as described in Example 1 using the following modification. Because of the very high level of effectiveness exhibited by the three component antioxidant system of the present invention it was necessary to run prolonged Sequence IIIE tests. The actual length of each IIIE test run is indicated in the viscosity results section of Table 2. These oils were blended to deliver approximately 740 ppm of ZDDP derived phosphorus to the finished oil and were formulated with an amount of polymeric dispersant sufficient for sludge control in the ultra low sulfur hydrocracked oils. The 100N and 240N ultra low sulfur hydrocracked base oils used are the same as defined in Example 1. The sulfurized hindered phenol was prepared in a manner analogous to that described in Example 2 of co-pending U.S. application Ser. No. 08/657,141 filed Jun. 3, 1996, and contained 10.75 wt % sulfur. The molybdenum 2-ethylhexanoate used was molybdenum octoate, an oil soluble molybdenum compound containing approximately 8.5 wt % molybdenum, commercially available from The Shepherd Chemical Company. The alkylated diphenylamine used was Naugalube® 680, an octyl/styryl diphenylamine available from Uniroyal Chemical Company, Inc.

TABLE 2

| Antioxidant evaluations in the Sequence IIIE | Oil #8 | Oil #9 |
|---|---|---|
| Antioxidant Type | | |
| Sulfurized Hindered t-butylphenol | 0.600 | 1.000 |
| Molybdenum 2-ethylhexanoate | 0.100 | 0.800 |
| alkylated diphenylamine | 0.300 | 0.300 |
| Base Oil Type | | |
| 100 N-Low sulfur hydrocracked base oil | 74.000 | 73.186 |
| 240 N-Low sulfur hydrocracked base oil | 8.000 | 7.912 |
| Analytical | | |
| Calculated P (ppm) | 740 | 732 |
| Calculated Mo (ppm) | 85 | 680 |
| Viscosity Increase Date (% change) | | |
| 8 hours | −4.2 | −6 |
| 16 hours | −0.9 | −5.1 |
| 24 hours | 4 | −1.5 |
| 32 hours | 7.8 | 2.2 |
| 40 hours | 9.7 | 5.5 |
| 48 hours | 6.3 | 8.5 |
| 56 hours | 33.2 | 10.9 |
| 64 hours (Single test complete) | 143.9 | 12.9 |
| 72 hours | 543.9 | 16 |
| 80 hours | TVTM* | 17.5 |
| 88 hours | TVTM* | 19.2 |
| 96 hours | | 20.1 |
| 104 hours | | 22.7 |
| 112 hours | | 27.5 |
| 120 hours | | 34.8 |
| 128 hours (Double test complete) | | 49.4 |

*Too viscous to measure

The Sequence IIIE results in Table 2 demonstrate a variety of benefits of the three component antioxidant system of the present invention. When a three component antioxidant system of the present invention is used in the low sulfur hydrocracked oils a significant improvement in the oils ability to control viscosity in the IIIE is seen (compare Oils #2–5 in Example 1 and Oils #8 and 9 in Example 2). Even though the ZDDP derived phosphorus levels in Oils #8 and 9 (approximately 740 ppm) are lower than the those of Example 1 (900 and 820 ppm), thus producing an oil more sensitive to oxidation and viscosity increase, a significantly more stable oil is seen due to the three component antioxidant system of the present invention.

Further, when the treat levels of the three way antioxidant system are increased (compare Oil #8 and Oil #9) even better IIIE viscosity results are obtained, i.e., Oil #9 passes a double run of the Sequence IIIE for the viscosity parameter with very little increase in viscosity.

Example 3

A sulfurized hindered phenol, a sulfurized olefin, an alkylated diphenylamine, and an oil soluble molybdenum compound were blended into an SAE grade 5W-30 passenger car motor oil as set forth in Table 3. The oils were formulated using identical additive package concentrates comprising polymeric dispersants, sulfonate detergents, zinc dialkyl dithiophosphate (ZDDP), an antifoam agent, a viscosity index improver, a pour point depressant, and a diluent process oil. These oils were blended to deliver approximately 820 ppm of ZDDP derived phosphorus to the finished oil and were formulated with an amount of polymeric dispersant sufficient for sludge control in the ultra low sulfur hydrocracked oils. The 100N and 240N ultra low sulfur hydrocracked base oils are as defined in Example 1. The sulfurized hindered phenol was prepared in a manner analogous to that described in Example 2 of co-pending U.S. application Ser. No. 08/657,141 filed Jun. 3, 1996, and contained 10.22 wt % sulfur. The molybdenum 2-ethylhexanoate used was molybdenum octoate, an oil soluble molybdenum compound containing approximately 8.5 wt % molybdenum, commercially available from The Shepherd Chemical Company. The alkylated diphenylamine used was Naugalube® 680, an octyl/styryl diphenylamine available from Uniroyal Chemical Company, Inc. The sulfurized olefin used was HiTEC® 7084 sulfurized olefin described in Example 1.

The oxidation stability of these oils was measured by pressurized differential scanning calorimetry (PDSC) as described by J. A. Walker and W. Tsang in "Characterization of Lubrication Oils by Differential Scanning Calorimetry", SAE Technical Paper Series, 801383 (Oct. 20–23, 1980). Oil samples were treated with an iron naphthenate catalyst (55 ppm Fe) and approximately 2 milligrams were analyzed in an open aluminum hermetic pan. The DSC cell was pressurized with 400 psi of air containing approximately 55 ppm $NO_2$ as an oxidation catalyst. The following heating sequence was used: Ramp 20° C./min to 120° C., Ramp 10° C./min to 150° C., Ramp 2.5° C. to 250° C., Isothermal for 1 minute. During the temperature ramping sequence an exothermic release of heat is observed. This exothermic release of heat marks the oxidation reaction. The temperature at which the exothermic release of heat is observed is called the oxidation onset temperature and is a measure of the oxidative stability of the oil (i.e., the higher the oxidation onset temperature the greater the oxidative stability of the oil). All oils are evaluated in triplicate and the results averaged, the results are set forth in Table 3.

The onset temperature results in Table 3 clearly show the advantage of the three way antioxidant system to control oxidation in fully formulated passenger car motor oils. Note that for entries containing only one or two components of the three component antioxidant system, there is an analogous three component entry that achieves equivalent or better results, i.e., equivalent or higher onset temperatures, with less additives. For example, oil #15 can achieve an onset temperature of 206.5 with the use of 0.9 wt % of an antioxidant system derived from the use of only two components (the diphenylamine represents one component and the combination of sulfurized olefin and sulfurized hindered phenol represents the second component). Within experimental error, oils #17 and #18 achieve the same onset temperature with, respectively, 0.675 wt % and 0.75 wt % of antioxidants derived from the three way system. Oil #20 achieves a higher onset temperature using only 0.575 wt % of antioxidant derived from the three way system. This type of response is seen consistently when comparing oils containing only one or two components with oils containing all three components. What is also important is that combinations of sulfurized olefins and sulfurized hindered phenols may be used to represent one of the components in the three component system. Some of the most powerful antioxidant combinations are seen when sulfurized olefins and sulfurized hindered phenols represent one component, with the remaining two components being molybdenum and diphenylamine (oils #22 through #26).

TABLE 3

Evaluation of Antioxidants by PDSC

| Oil # | Alkylated diphenylamine % | Sulfurized Olefin % | % S from Sulfurized Olefin | Sulfurized Hindered Phenol % | Oil soluble Molybdenum % | ppm Mo | Total Antioxidant Used % | Onset Temperature °C. |
|---|---|---|---|---|---|---|---|---|
| 10* | 0.20 | | | | | | 0.2 | 196.9 |
| 11* | 0.20 | 0.40 | 0.08 | | | | 0.6 | 200.6 |
| 12* | 0.20 | 0.80 | 0.16 | | | | 1 | 203.5 |
| 13* | 0.20 | | | 0.60 | | | 0.8 | 205.7 |
| 14* | 0.20 | | | | 0.150 | 128 | 0.35 | 202 |
| 15* | 0.20 | 0.40 | 0.08 | 0.30 | | | 0.9 | 206.5 |
| 16* | 0.20 | 0.80 | 0.16 | 0.60 | | | 1.6 | 210.8 |
| 17 | 0.20 | 0.40 | 0.08 | | 0.075 | 64 | 0.675 | 206.2 |
| 18 | 0.20 | 0.40 | 0.08 | | 0.150 | 128 | 0.75 | 206.3 |
| 19 | 0.20 | 0.80 | 0.16 | | 0.150 | 128 | 1.15 | 207.9 |
| 20 | 0.20 | | | 0.30 | 0.075 | 64 | 0.575 | 207.8 |
| 21 | 0.20 | | | 0.60 | 0.150 | 128 | 0.95 | 210.8 |
| 22 | 0.20 | 0.40 | 0.08 | 0.30 | 0.075 | 64 | 0.995 | 210.3 |
| 23 | 0.20 | 0.40 | 0.08 | 0.60 | 0.075 | 64 | 1.275 | 212.3 |
| 24 | 0.20 | 0.40 | 0.08 | 0.30 | 0.150 | 128 | 1.05 | 211.9 |
| 25 | 0.20 | 0.80 | 0.16 | 0.30 | 0.075 | 64 | 1.375 | 212.1 |
| 26 | 0.20 | 0.80 | 0.16 | 0.60 | 0.150 | 128 | 1.75 | 215.9 |

*Comparative examples

Example 4

The following example shows the benefit of using sulfur-free molybdenum compounds versus sulfurized molybdenum compounds in crankcase lubricants.

A series of heavy duty diesel engine oils were blended as defined in Table IV. The oils were formulated using polymeric dispersants, sulfonate and phenate detergents, ZDDP, an anti-foam agent, a viscosity index improver, a pour point depressant, antioxidants, a diluent process oil, and a base oil, to prepare molybdenum-free SAE grade 15W-40 motor oils. The finished oils were then top treated with a variety of sulfur containing and sulfur-free molybdenum compounds to deliver approximately 500 ppm molybdenum to each blend. The molybdenum compounds used were as follows: Sakura-Lube® 155, a sulfur containing molybdenum dithiocarbamate available from Asahi Denka Kogyo K. K.; Sakura-Lube® 700, a sulfur-free molybdenum amine complex available from Asahi Denka Kogyo K. K.; Molyvan® 807 and 822, sulfur containing molybdenum dithiocarbamates available from R. T. Vanderbilt Company, Inc.; Molyvan® 855, a sulfur-free organomolybdenum compound available from R. T. Vanderbilt Company, Inc.; and Molybdenum Octoate, a sulfur-free molybdenum carboxylate available from The Shepherd Chemical Company. These oils were evaluated for nitrile elastomer compatibility using the Allison C-4 Nitrile Seal Test, method GM 6137-M, test J1, total immersion conditions. The tested nitrile elastomers were rated for hardness change. This parameter is especially sensitive to sulfurized additives in the finished oil. Active sulfur has the effect of hardening these seals, i.e., show an increase in the hardness rating. The results are shown in Table 4. Note that although all molybdenum compounds show an improvement relative to the molybdenum-free reference, the sulfur-free molybdenum compounds show the largest improvement. This is an advantage of the sulfur-free molybdenum compounds since it allow greater flexibility in the level and type of sulfurized antioxidants that can be used in combination with molybdenum and diphenylamines.

TABLE 4

Nitrile Seal Evaluation of Molybdenum Compounds

| Oil # | SAE 15W-40 Oil (wt %) | Molybdenum Compound | Wt % Mo Compound | Diluent Oil (wt %) | ppm Mo Delivered to Oil | Hardness Change (+5 to −5) |
|---|---|---|---|---|---|---|
| 27 | 98.2 | None | 0 | 1.8 | 0 | +5 |
| 28 | 98.2 | Molyvan ® 855 | 0.63 | 1.18 | 500 | 0 |
| 29 | 98.2 | Sakura-Lube ® 700 | 1.11 | 0.69 | 500 | +1 |
| 30 | 98.2 | Molybdenum Octoate | 0.59 | 1.21 | 500 | +1 |
| 31 | 98.2 | Molyvan ® 807 | 1.02 | 0.78 | 500 | +2 |
| 32 | 98.2 | Molyvan ® 822 | 1.02 | 0.78 | 500 | +2 |
| 33 | 98.2 | Sakura-Lube ® 155 | 1.11 | 0.69 | 500 | +2 |

Example 5

The following example shows how sulfur-free molybdenum compounds can be used in this invention to produce nitrile seal compatible lubricants.

A sulfurized hindered phenol, a sulfurized olefin, an alkylated diphenylamine, and an oil soluble molybdenum compound were blended into an SAE grade 5W-30 passenger car motor oil as shown in Table V. The oils were formulated using polymeric dispersants, sulfonate detergents, ZDDP, an anti-foam agent, a viscosity index improver, a pour point depressant and a diluent process oil. These oils were blended to deliver approximately 820 ppm, of ZDDP derived phosphorus to the finished oil and were formulated with an amount of polymeric dispersant sufficient for sludge control in the ultra low sulfur hydrocracked oils. The 100N and 240N ultra low sulfur hydrocracked base oils used were those defined in Example 1. The sulfurized hindered phenol was prepared in a manner analogous to that described in Ser. No. 08/877,533 filed Feb. 19, 1997, Example 1, and contained approximately 6.6 wt % sulfur. The molybdenum compound used was Molyvan® 855, an oil soluble organomolybdenum complex of an organic amide containing approximately 8.0 wt % molybdenum obtain from R. T. Vanderbilt Company, Inc. The alkylated diphenylamine used was an octyl/styryl alkylated diphenylamine available from The BF Goodrich Company, Inc. The sulfurized olefin used was HiTEC® 7084 sulfurized olefin, which is a $C_{16}$–$C_{18}$ sulfurized olefin containing approximately 20 wt % sulfur obtained from Ethyl Corporation. These oils were evaluated for nitrile elastomer compatibility using the Allison C-4 Nitrile Seal Test as defined in Example 4. The results are shown in Table 5. Note that samples without molybdenum fail the nitrile seal test for hardness rating while samples containing molybdenum pass. This effect is important because it allows one to use higher levels of sulfurized olefins and sulfurized hindered phenols without having nitrile seal incompatibility.

TABLE 5

Nitrile Seal Evaluation

| Oil # | Diphenylamine (wt %) | Sulfurized Hindered Phenol (wt %) | Sulfurized Olefin (wt %) | Molybdenum Compound (wt %, ppm Mo) | Diluent Oil (wt %) | SAE 5W-30 Oil (wt %) | Hardness Change (+5 to −5) |
|---|---|---|---|---|---|---|---|
| 34 | 0.3 | | | 0, 0 | 1.7 | 98 | +6 |
| 35 | 0.3 | 0.7 | | 0, 0 | 1 | 98 | +6 |
| 36 | 0.3 | 0.7 | | 1.0, 800 | | 98 | +1 |
| 37 | 0.3 | | 0.7 | 0, 0 | 1 | 98 | +7 |
| 38 | 0.3 | | 0.7 | 1.0, 800 | | 98 | +1 |

sulfur hydrocracked base oil used was that defined in Example 1. The sulfurized hindered phenol used was prepared in a manner analogous to that described in Ser. No. 08/877,533 filed Feb. 19, 1997, example 1, and contained 6.6 wt % sulfur. The molybdenum compounds used were as follows: molybdenum octoate, a sulfur-free molybdenum compound containing approximately 8.5 wt % molybdenum obtained from The Shepherd Chemical Company; Sakura-Lube® 700, a sulfur-free molybdenum amine complex available from Asahi Denka Kogyo K. K.; Molyvan® 822, a sulfur containing molybdenum dithiocarbamate available from R. T. Vanderbilt Company, Inc.; and Molyvan® 855, a sulfur-free organomolybdenum compound available from R. T. Vanderbilt Company, Inc. The alkylated diphenylamine used was an octyl/styryl alkylated diphenylamine available from The BF Goodrich Chemical Company, Inc. The oxidation stability of these oils was measured by pressurized differential scanning calorimetry (PDSC) as defined in Example 3. The results are shown in Table 6. All samples (Oil #39–53) contained 97.30 wt % base 5W-30 Oil blend and an amount of process diluent oil sufficient to make 100 wt % of the total composition including base oil blend, antioxidant(s) and diluent oil. Note that if any one or two components of this invention is absent (oil blends 40 through 49), an oil with poor oxidative stability is produced. This example demonstrates the importance of having all three components, the diarylamine, the sulfurized hindered phenol, and the oil soluble molybdenum compound, to produce an oil with a high level of oxidative stability (oil blends 50 through 53) as indicated by the desired higher onset temperatures.

TABLE 6

Evaluation of Antioxidants by PDSC

| Oil # | Aklylated Diphenylamine (wt %) | Sulfurized Hindered Phenol (wt %) | Molybdenum Compound | Oil Soluble Molybdenum (wt %, ppm Mo) | Onset Temperature °C. |
|---|---|---|---|---|---|
| 39* | | | | | 177.7 |
| 40* | | 0.70 | | | 195.3 |
| 41* | | | Molyvan ® 855 | 0.63, 500 | 180.2 |
| 42* | | | Molyvan ® 822 | 1.02, 500 | 186.4 |
| 43* | | 0.70 | Mo Octoate | 0.59, 500 | 196.7 |
| 44* | | 0.70 | Molyvan ® 855 | 0.63, 500 | 197.1 |
| 45* | | 0.70 | Molyvan ® 822 | 1.02, 500 | 201.2 |
| 46* | | 0.70 | Sakura-Lube ® 700 | 1.11, 500 | 198.2 |
| 47* | 0.20 | | Molyvan ® 855 | 0.63, 500 | 198.5 |
| 48* | 0.20 | | Molyvan ® 822 | 1.02, 500 | 201.2 |
| 49* | 0.20 | 0.70 | | | 202.4 |
| 50 | 0.20 | 0.70 | Mo Octoate | 0.59, 500 | 209.5 |
| 51 | 0.20 | 0.70 | Molyvan ® 855 | 0.63, 500 | 209.1 |
| 52 | 0.20 | 0.70 | Molyvan ® 822 | 1.02, 500 | 212.6 |
| 53 | 0.20 | 0.70 | Sakura-Lube ® 700 | 1.11, 500 | 210 |

*Comparative Examples

Example 6

A sulfurized hindered phenol, an alkylated diphenylamine, and oil soluble molybdenum compounds were blended into an SAE grade 5W-30 passenger car motor oil as shown in Table 6. The oils were formulated using polymeric dispersant, sulfonate detergents, ZDDP, an antifoam agent, a viscosity index improver, a pour point depressant and a diluent process oil. These oils were blended to deliver approximately 700 ppm of ZDDP derived phosphorus to the finished oil and were formulated with an amount of polymeric dispersant sufficient for sludge control in the ultra low sulfur hydrocracked oils. The 100N ultra low This invention is susceptible to considerable variation in its practice. Accordingly, this invention is not limited to the specific exemplifications set forth hereinabove. Rather, this invention is within the spirit and scope of the appended claims, including the equivalents thereof available as a matter of law.

The patentee does not intend to dedicate any disclosed embodiments to the public, and to the extent any disclosed modifications or alterations may not literally fall within the scope of the claims, they are considered to be part of the invention under the doctrine of equivalents.

I claim:

1. An antioxidant system comprising:

(A) a secondary diarylamine, (B) at least one member selected from the group consisting of sulfurized olefins and sulfurized hindered phenols, and (C) an oil soluble, sulfur-containing molybdenum compound.

2. The antioxidant system of claim 1 wherein (B) is a sulfurized hindered phenol of the formula:

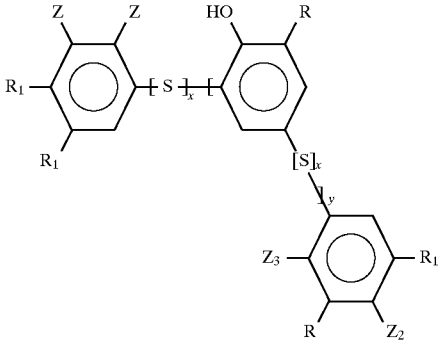

wherein R is an alkyl group, $R_1$ is selected from the group consisting of alkyl groups and hydrogen, one of Z or $Z_1$ is OH with the other being hydrogen, one of $Z_2$ or $Z_3$ is OH with the other being hydrogen, x is in the range of from 1 to 6, and y is in the range of from 0 to 2.

3. The antioxidant system of claim 1 wherein (B) is a mixture of at least one sulfurized olefin and at least one sulfurized hindered phenol.

4. A lubricating composition comprising an oil of lubricating viscosity and the antioxidant composition of claim 1, wherein component (C) is present in an amount such that the total molybdenum content is about 60 to about 1000 ppm by weight of the total lubricating composition.

5. The lubricating composition of claim 4 wherein the oil of lubricating viscosity contains greater than or equal to 90% by weight of saturates, and less than or equal to 500 ppm sulfur.

6. The lubricating composition of claim 4 comprising at least one member selected from the group consisting of dispersants, detergents, anti-wear agents, supplemental antioxidants, viscosity index improvers, pour point depressants, corrosion inhibitors, rust inhibitors, foam inhibitors, and friction modifiers.

7. The lubricating composition of claim 6 wherein the lubricating composition contains less than about 850 ppm by weight of total phosphorus.

8. The lubricating composition of claim 4 wherein component (A) is present in an amount of about 0.05 to about 0.5 percent by weight of the total lubricant composition.

9. The lubricating composition of claim 4 wherein component (B) is selected from a sulfurized olefin, in an amount such that about 0.05 to about 0.30 percent by weight of sulfur from the sulfurized olefin is delivered to the finished lubricant composition, and sulfurized hindered phenols, in an amount of about 0.3 to about 1.5 percent by weight of the total lubricant composition.

10. An additive concentrate comprising the antioxidant system of claim 1 and a diluent process oil.

11. The additive concentrate of claim 10 further comprising at least one member selected from the group consisting of dispersants, detergents, anti-wear agents, supplemental antioxidants, viscosity index improvers, pour point depressants, corrosion inhibitors, rust inhibitors, foam inhibitors, and friction modifiers.

12. A method of reducing the oxidative environment in a lubricating oil composition, said method comprising adding to said lubricating oil an effective amount of the antioxidant system of claim 1.

13. An antioxidant system comprising:

(A) a secondary diarylamine, (B) at least one member selected from the group consisting of sulfurized olefins and sulfurized hindered phenols, and (D) an oil soluble, sulfur-free molybdenum compound.

14. The antioxidant system of claim 13 wherein (B) is a sulfurized hindered phenol of the formula:

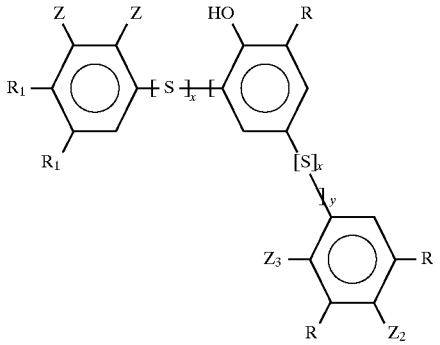

wherein R is an alkyl group, $R_1$ is selected from the group consisting of alkyl groups and hydrogen, one of Z or $Z_1$ is OH with the other being hydrogen, one of $Z_2$ or $Z_3$ is OH with the other being hydrogen, x is in the range of from 1 to 6, and y is in the range of from 0 to 2.

15. The antioxidant system of claim 13 wherein (B) is a mixture of at least one sulfurized olefin and at least one sulfurized hindered phenol.

16. A lubricating composition comprising an oil of lubricating viscosity and the antioxidant composition of claim 13, wherein component (C) is present in an amount such that the total molybdenum content is about 60 to about 1000 ppm by weight of the total lubricating composition.

17. The lubricating composition of claim 16 wherein the oil of lubricating viscosity contains greater than or equal to 90% by weight of saturates, and less than or equal to 500 ppm sulfur.

18. The lubricating composition of claim 16 further comprising at least one member selected from the group consisting of dispersants, detergents, anti-wear agents, supplemental antioxidants, viscosity index improvers, pour point depressants, corrosion inhibitors, rust inhibitors, foam inhibitors, and friction modifiers.

19. The lubricating composition of claim 18 wherein the lubricating composition contains less than about 850 ppm by weight of total phosphorus.

20. The lubricating composition of 16 wherein component (A) is present in an amount of about 0.05 to about 0.5 percent by weight of the total lubricant composition.

21. The lubricating composition of claim 16 wherein component (B) is selected from a sulfurized olefin, in an amount such that about 0.05 to about 0.30 percent by weight of sulfur from the sulfurized olefin is delivered to the finished lubricant composition, and sulfurized hindered phenols, in an amount of about 0.3 to about 1.5 percent by weight of the total lubricant composition.

22. An additive concentrate comprising the antioxidant system of claim 13 and a diluent process oil.

23. The additive concentrate of claim 22 further comprising at least one member selected from the group consisting of dispersants, detergents, anti-wear agents, supplemental antioxidants, viscosity index improvers, pour point depressants, corrosion inhibitors, rust inhibitors, foam inhibitors, and friction modifiers.

24. A method of reducing the oxidative environment in a lubricating oil composition, said method comprising adding to said lubricating oil an effective amount of the antioxidant system of claim 13.

* * * * *

UNITED STATES PATENT AND TRADEMARK OFFICE

CERTIFICATE OF CORRECTION

PATENT NO. : 5,840,672

DATED : 11/24/98

INVENTOR(S) : Vincent James Gatto

It is certified that error appears in the above-indentified patent and that said Letters Patent is hereby corrected as shown below:

Column 4, lines 20-34 (Figure) - change "Z' meta to the sulfur bridge to -- R --;

lines 20-34 (Figure) - change "R1" para to the sulfur bridge to -- Z1 --;

Column 9, line 38 - change "Table I" to -- Table 1 --;

Column 11, line 42 - after "than" delete -- the --;

Column 13, line 32 - change "Table IV" to -- Table 4 --;

Column 14, line 54 - change "Table V" to -- Table 5 --;

Column 17, lines 11-25 (Figure) - change "Z" meta to the sulfur bridge to -- R --;

lines 11-25 (Figure) - change "R1" para to the sulfur bridge to -- Z1 --;

UNITED STATES PATENT AND TRADEMARK OFFICE

CERTIFICATE OF CORRECTION

PATENT NO. : 5,840,672

DATED : 11/24/98

INVENTOR(S) : Vincent James Gatto

It is certified that error appears in the above-identified patent and that said Letters Patent is hereby corrected as shown below:

Column 18, line 12, (Claim 13) - change "(D)" to -- (C) --;

Column 18, lines 15-29 (Figure) - change "R" meta to the sulfur bridge to -- R1 --;

lines 15-29 (Figure) - change "Z" meta to the sulfur bridge to -- R --;

lines 15-29 (Figure) - change "R1" para to the sulfur bridge to -- Z1 --;

Table 6 - change "Aklyated" to -- Alkylated --.

Signed and Sealed this

Thirteenth Day of April, 1999

*Attest:*

Q. TODD DICKINSON

*Attesting Officer*

*Acting Commissioner of Patents and Trademarks*